United States Patent [19]

Godfrey et al.

[11] 4,126,368

[45] Nov. 21, 1978

[54] ELECTRICAL FUSE HOLDER

[75] Inventors: William T. Godfrey, Enfield; Edith R. Paull, Woodford Green, both of England

[73] Assignee: Belling & Lee Limited, Enfield, England

[21] Appl. No.: 784,503

[22] Filed: Apr. 4, 1977

[30] Foreign Application Priority Data

Apr. 15, 1976 [GB] United Kingdom ..... 15734/76

[51] Int. Cl.[2] ..... H01H 85/22

[52] U.S. Cl. ..... 339/91 R; 337/196; 339/128; 339/150 F; 339/258 F

[58] Field of Search ..... 339/91 R, 147 R, 147 P, 339/150 F, 252 F, 253 F, 256 C, 258 F, 262 F, 128; 337/194, 196, 201, 215, 237, 211–213

[56] References Cited

U.S. PATENT DOCUMENTS 2,424,757 7/1947 Klumpp, Jr. ..... 339/128

2,700,712 1/1955 Stinson ..... 337/196

3,699,500 10/1972 Borzoni et al. ..... 339/91 R

FOREIGN PATENT DOCUMENTS 2,205,324 8/1972 Fed. Rep. of Germany ..... 339/91 R

*Primary Examiner*—Neil Abrams

*Attorney, Agent, or Firm*—Lawrence E. Laubscher

[57] ABSTRACT

An electrical fuse holder for mounting a cartridge fuse comprises a panel-mountable body of insulating material formed with a central slot of a size allowing the passage of a fuse from an access aperture until its caps engage in respective contact members. The fuse is resiliently held in a carrier of insulating material provided with outwardly extending resilient catch portions that engage lips on the body member to retain the carrier in position. Finger pressure on the accessible portion of the carrier releases the catches from the lips to allow withdrawal of the fuse.

9 Claims, 9 Drawing Figures

ELECTRICAL FUSE HOLDER

BACKGROUND OF THE INVENTION

1. Field of the Invention

The invention relates to electrical fuse holders for accepting cartridge fuses as now generally used for relatively small currents (up to 30 amperes) and low voltages (below 1000 V. a.c. or 1500 V. d.c.)

2. Description of the Prior Art

A very wide variety of fuse holders of this general type is already known.

In one extensive class of fuse holders for cartridge fuses the fuse catridge is frictionally held by one end cap in a first contact member mounted in a cap member of insulating material which is engageable upon an end of a generally tubular body member of insulating material into which the fuse cartridge is inserted so that its other end cap makes resilient contact with a second contact member connected directly to one terminal member of the fuse holder. A part of the first contact member is arranged, when the cap member is engaged upon the tubular body member, to make electrical contact with an electrical conductor connected to another terminal member of the fuse holder. Although some fuse holders of this general construction are proof against accidental contact between an operator's finger and a possibly live contact member or terminal member of the fuse holder, all suffer from the disadvantage that an additional frictional electrical connection is necessary in the electrical circuit between the contact member in the cap member and the associated terminal member. Fuse holders of this type are therefore often suitable for low currents, for example, up to five amperes.

In another extensive class of cartridge fuse holders, the fuse holder comprises a body member provided with a slot into which a fuse cartridge may be placed laterally, with its end caps simultaneously engaging in respective contact clips. To avoid the necessity for an operator to extract the cartridge from the clips, some such fuse holders have a lid-like carrier member provided internally with a means for grasping the portion of the fuse cartridge intermediate the end caps. It is however, a disadvantage of this type of fuse holder that manual contact with the possibly live fuse clips is very possible. It is a further disadvantage of known fuse holders of this type that dislodgement of the fuse carrier and fuse can rather readily occur by accidental contact with a projecting portion of the carrier provided for ease in handling.

SUMMARY OF THE INVENTION

The invention provides a cartridge fuse holder having advantages over fuse holders of the prior art.

It is an object of the invention to provide a cartridge fuse holder in which the necessity for frictional electrical or resilient contact other than between the fuse end caps and their respective contact members is avoided.

It is also an object of the invention to provide a cartridge fuse holder in which digital contact with possibly live contact members is prevented.

It is a further object of the invention to provide a cartridge fuse holder in which accidental dislodgement of the fuse is impossible, though intentional removal is very readily performed.

It is another object of the invention to provide a fuse holder that comprises a minimum of individual parts and is therefore cheap to manufacture.

Figure 1:
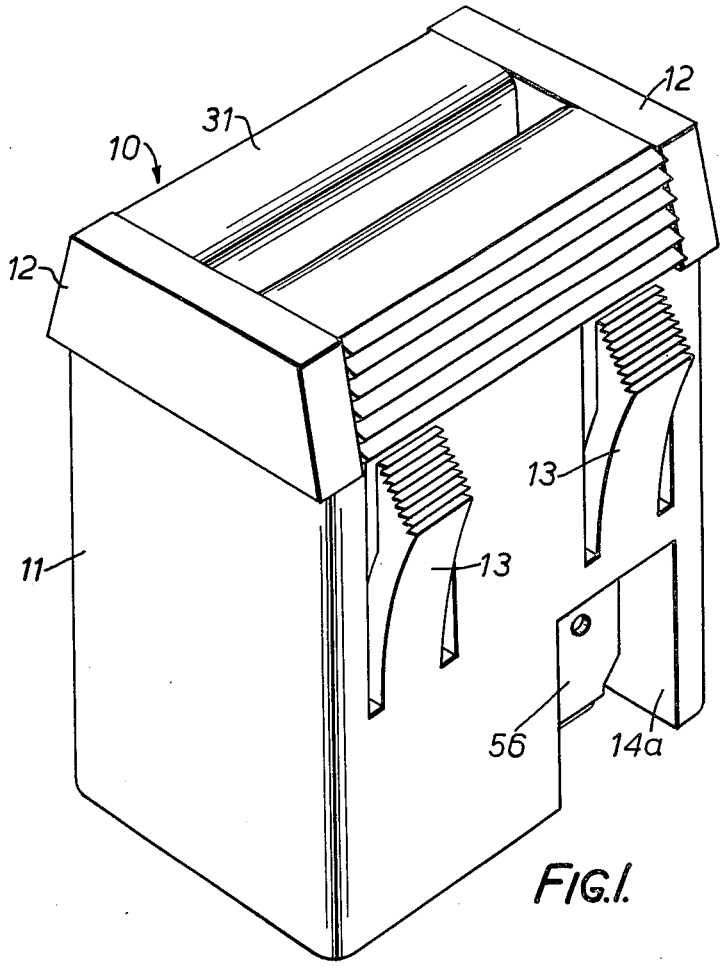
FIG. 1 is a perspective view of a fuse holder assembly.
Figure 2:
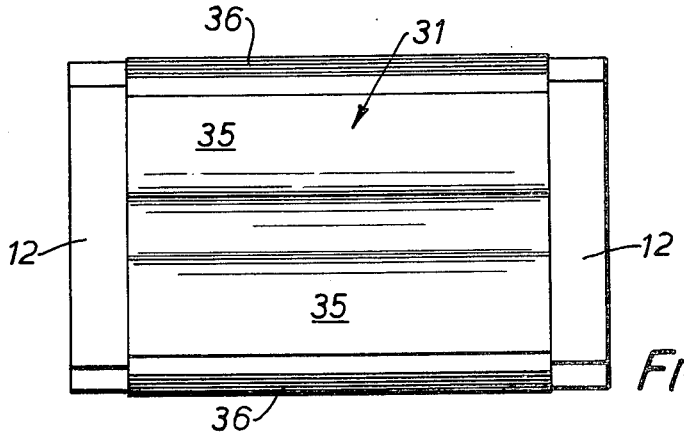
FIG. 2 is a plan view of the fuse holder assembly of FIG. 1.
Figure 3:
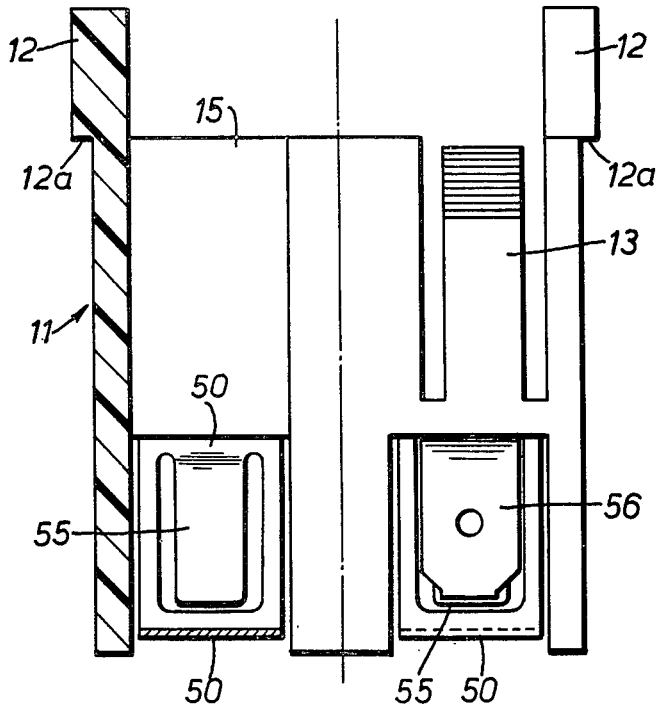
FIG. 3 is a front elevation of a body portion of the assembly of FIGS. 1 and 2, the lefthand half being in section along line 3—3 in FIG. 4.
Figure 4:
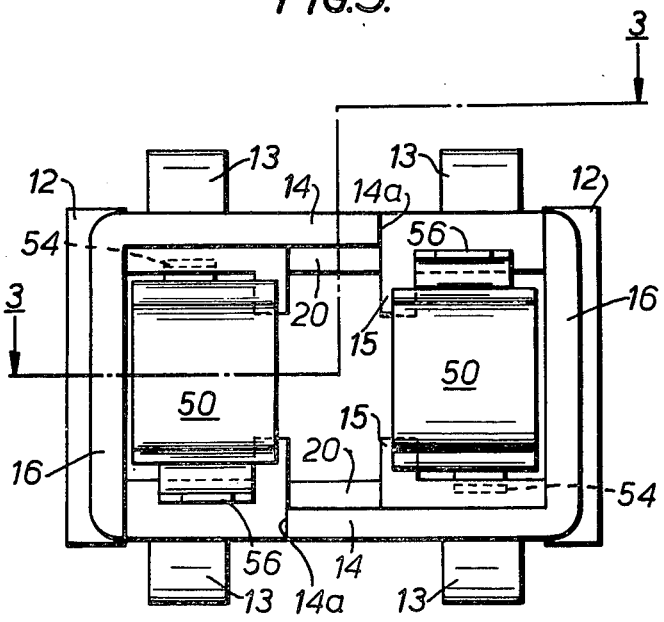
FIG. 4 is an inverted plan view of the body portion shown in FIG. 3.
Figure 5:
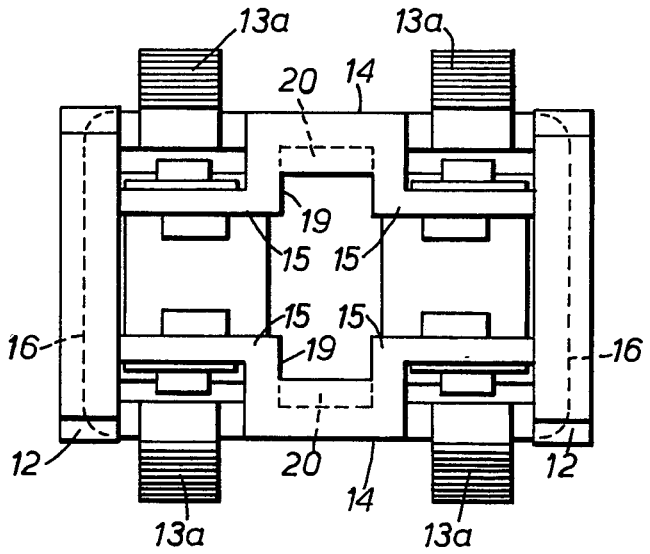
FIG. 5 is a plan view of the body portion shown in FIGS. 3 and 4.

The fuse holder 10 shown in the drawings comprises as its main components a body portion 11 and a fuse carrier portion 31. Body portion 11 is generally of rectangular parallelepipoidal form having end portions 12 extending upwardly from its narrow ends as shown in the drawings. It will be understood that the fuse holder may in use be mounted in any attitude and that directional features mentioned in the description are not to be understood as imposing any limitation to a particular mounting attitude. Shoulders 12*a* formed on end portions 12 extend laterally and endwise beyond the general body portion, as best seen in FIG. 3, to define a plane and provide a locating means for the fuse holder when, as is intended, this is mounted in a rectangular aperture formed in a mounting panel, the shoulder portions 12*a* then abut against the front surface of the panel. The fuse holder is held in its mounted position by resilient arms 13 having stepped upper end portions 13*a*. Arms 13 extend curvedly outwards from the outer side walls 14 of the body portion 11 and when this is inserted in a rectangular aperture of which the length and width slightly exceed the length L and width W of body portion 11, as shown in FIG. 4, stepped ends 13*a* on arms 13 will engage the rear margins of the aperture to provide snap mounting of the device.

Figure 6:
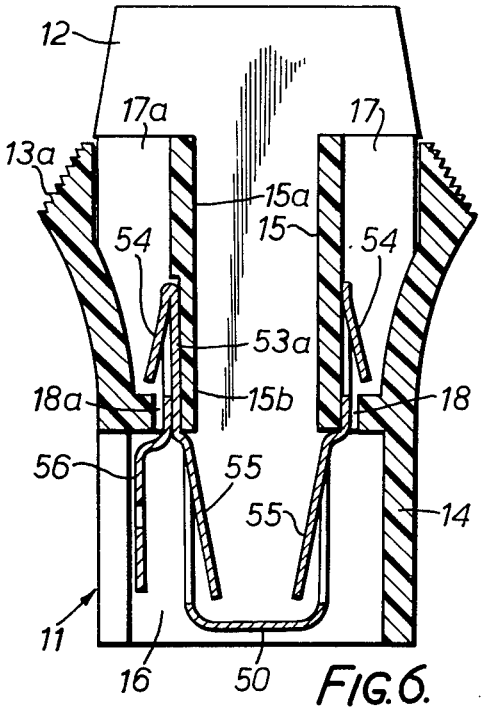
FIG. 6 is a sectional end elevation of the body portion, showing a contact member.
Figure 7:
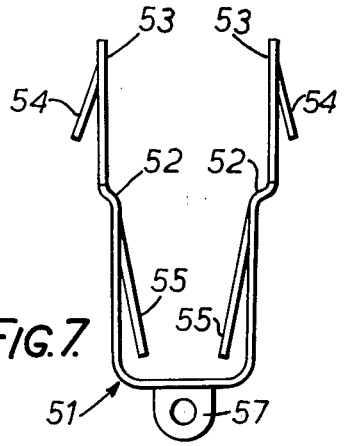
FIG. 7 is an end view of an alternative form of contact member.
Figure 8:
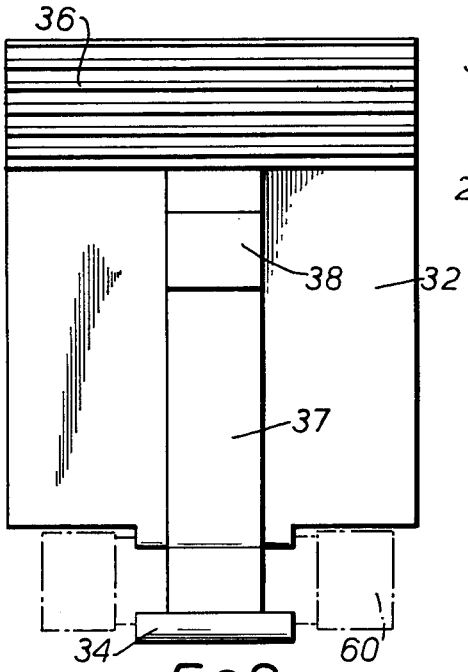
FIG. 8 is a front elevation of a fuse carrier portion of the assembly shown in FIGS. 1 and 2.
Figure 9:
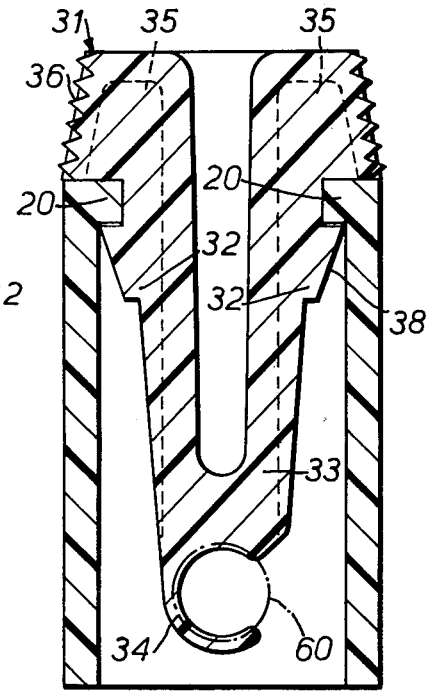
FIG. 9 is a sectional end elevation of the assembly shown in FIGS. 1 and 2.

Within body member 11 and generally parallel to its outer side walls 14 there extend, at each end of the body portion, internal or partition walls 15, L-shaped in plan, that enclose with the adjacent side walls 14 and end walls 16 rectangular pockets 17 having narrow slots 18 formed in their bottoms (FIG. 6) in which are mounted respective contact members 50 or 51, the respective forms of which are best seen in FIGS. 6 and 7. The contact members, formed of suitably resilient metal sheet, are generally U-shaped, with an outward jog or offset 52 formed medially of each upwardly extending arm 53.

At the upper end of each arm 53 is formed an outwardly and downwardly projecting tab 54 which, when the contact member is mounted in body member 11 by urging the upper ends of its arms through slots 18, reassumes its original form to retain the contact members in the body member. In the lower portions of the arms of the contact members are formed inwardly extending contact tongues 55 which engage an end cap of a fuse mounted in the holder. The means for making connection between the fuse holder contacts and external wiring may be varied to suit different applications. Contact member 50, shown in FIG. 6 and elsewhere, is provided with a reflexly bent spade portion 56 that extends parallel to, though offset from one arm for engagement by a known form of wiring terminal.

Outer side walls 14 of body portion 11 are cut away at 14*a* to allow access to contact spades 56. Immediately above wide slot 18*a* through which the doubled arm 53*a* enters its respective pocket 17*a* the surface of partition wall 15*a* bounding the pocket is recessed at 15*b* to provide room for the doubled arm.

Contact member 51, shown in FIG. 7, lacks this spade but is provided instead with a downwardly extending apertured soldering tag 57 extending from its central portion. Other modifications of form to provide for different means of connection are obviously possible.

The parts of partition walls 15 that extend parallel to side wall 18 define between them a central slot 19 to accept a fuse carrier 31.

A fuse to be inserted in the holder is carried in the fuse carrier 31. This portion of the assembly comprises a common portion having on one side a fuse gripping means and having extending from its other side spaced-apart limb portions. In the illustrated embodiment the fuse carrier 31 comprises a generally bifurcate member having parallel, spaced-apart laminar limb portions 32 extending upwardly from a base portion 33 on the underside of which is formed a somewhat resilient C-shaped clip portion 34 which grips the body of the cartridge fuse shown in broken line at 60. The upper portions of wall portions 32 are formed with out-turned flanges 35 and downwardly extending ridged finger-pieces 36 by which the fuse carrier may conveniently be handled. Centrally of each of wall portions 32 is provided a preferably downwardly tapering rib 37 which is of a size to fit slidingly within one of the slots formed within body portion 11 between adjacent ends of partition walls 15 to guide the fuse carrier during insertion into the body portion. Towards the upper ends of rib 37 are provided catch portions 38 which, when the fuse carrier is inserted in the body portion, engage below inwardly extending abutments 20 formed on walls 14 at the upper ends of slots 19. To remove the fuse carrier from the body portion, finger pieces 36 are squeezed towards one another, thus disengaging catches 38 from abutments 20 and permitting the upward withdrawal of the fuse carrier from the body portion.

The fact that the contact clips in which the fuse engages are disposed, as regarded from the front of the panel in which the fuse holder is mounted, at the bottom of a deep and narrow slot provides the advantage that the contacts are completely safe from finger contact. A further advantage is that removal of the fuse carrier for fuse replacement is extremely convenient, rapid and entirely safe.

It will be understood that the depth of body member 11, and therefore of walls 15 defining slot 19, may be changed to ensure that contacts 50 are protected from contact with probes of different forms, so as to comply with particular safety specifications.

Although only a particular embodiment of the invention has been described and illustrated, it will be apparent to those skilled in the art that various modifications and alterations may be made therein. It is therefore the intention in the appended claims to cover all such modifications and alterations as may fall within the true spirit and scope of the invention.

We claim:

1. An electrical fuse holder for a fuse cartridge comprising an insulating body portion extending between conductive end caps, said fuse holder comprising an insulating body member generally in the form of a rectangular parallelepiped comprising opposed pairs of longer outer side wall portions and shorter end wall portions the narrower ends of said body member extending laterally and endwise beyond said wall portions, thereby to form locating surfaces, said outer side walls having outwardly curved retaining portions extending towards said locating surfaces and ending in serrated slant surfaces, said body member further including parallel inner side wall portions defining therebetween a fuse carrier receiving slot, too narrow to admit a human finger, said inner side wall portions spaced from said outer side wall portions adjacent said end walls to form therebetween contact member locating pockets having slotted bases and united with said outer side wall portions medially thereof to form opposed rectangular grooves extending inwardly of said slot, said fuse holder further comprising generally U-shaped contact members non-returnably engaging through said slots in said pocket bases, said contact members resiliently engaging said fuse cartridge end caps, said fuse holder further comprising a unitary fuse carrier member of moulded insulating material, said member having spaced-apart parallel laminar limb portions united at one end into a common portion and having at their other ends mutually outwardly extending ginger pieces provided with serrated, outwardly facing surfaces and having extending from said finger pieces to said common portion centrally disposed rib portions provided with outwardly projecting catch members having slant surfaces directed towards said common portion and catch surfaces spaced from the adjacent faces of said finger pieces, said common portion having centrally thereof, on the side opposite to that from which said limb portions extend, a C-shaped protrusion embracing a notch resiliently engageable with said fuse cartridge.

2. An electric fuse holder for a fuse having an insulated body portion arranged between conductive end caps, comprising (a) a body member formed of insulating material and having a generally rectangular parallelepipedal configuration, said body member including
  (1) means for securing said body member to a support member; and
  (2) first wall members having abutment portions and defining a fuse receiving slot, said fuse receiving slot being medially positioned within said body member and including opposite end portions to permit slidable passage of said fuse and a wider central portion forming grooves extending within said slot;

(b) contact means arranged within said fuse receiving slot; and (c) fuse carrier means formed of insulating material adapted to be received by said fuse receiving slot and including
  (1) fuse gripping means for gripping the insulated body portion of the fuse; and
  (2) spaced resilient limb means each having one end adjacent said fuse gripping means and having a free end which extends from said fuse receiving slot, said limb means comprising spaced parallel rectangular laminar portions arranged for sliding relation within said fuse receiving slot, said limb portions being provided at their free ends with oppositely extending finger-grip portions which abut the top of said first body wall members to limit the insertion of said fuse carrier means within said slot, said limb portions including rib portions in their outer surfaces, respectively, medially of their length, said rib portions being slidable within said grooves and having catch means arranged thereon which cooperate with said first body wall groove abutment portions to secure said fuse carrier means within said fuse receiving slot, whereby when said fuse carrier means is arranged within said fuse receiving slot, the conductive end caps of the fuse are in contact with said contact means, and upon deflection of said limb means toward one another, said catch means are released from said first body wall groove abutment portions and said fuse carrier means is displaceable from said fuse receiving slot.

3. An electric fuse holder for a fuse having an insulated body portion arranged between conductive end caps, comprising (a) a body member formed of insulating material and including
  (1) means for securing said body member to a support member;
  (2) first wall members having abutment portions and defining a fuse receiving slot; and
  (3) second wall members adjacent to and spaced from said first wall members to define recesses therebetween, the bases of said recesses containing further slots therein;

(b) contact means arranged within said fuse receiving slot comprising
  (1) a U-shaped metal strip having opposed inwardly biased resilient tongues adjacent its base portion, said tongues being engageable with said fuse conductive end caps;
  (2) mounting portions arranged at the upper ends of said U-shaped metal strip and including resilient tongues extending toward the base portion of said strip and arranged to engage the base of a respective recess after insertion of said U-shaped strip into said further slot; and
  (3) terminal means connected with said U-shaped strip; and (c) fuse carrier means formed of insulating material adapted to be received by said fuse receiving slot and including
  (1) fuse gripping means for gripping the insulated body portion of the fuse, and
  (2) spaced, resilient limb means each having one end adjacent said fuse gripping means and having a free end which extends from said fuse receiving slot, said limb means including catch means adjacent their free ends which cooperate with said first body wall abutment portions to secure said fuse carrier means within said fuse receiving slot, whereby when said fuse carrier means is arranged within said fuse receiving slot, the conductive end caps of the fuse are in contact with said contact means, and upon deflection of said limb means toward one another, said catch means are released from said first body wall abutment portions and said fuse carrier means is displaceable from said fuse receiving slot.

4. A fuse holder as defined in claim 3, wherein said terminal means comprises one end portion of said U-shaped strip reflexly folded and spaced from said base portion.

5. A fuse holder as defined in claim 3, wherein said terminal means comprises an apertured lug projecting from said contact member base portion.

6. An electric fuse holder for a fuse having an insulated body portion arranged between conductive end caps, comprising (a) a body member formed of insulating material, said body member including
  (1) means for securing said body member to a support member; and
  (2) first wall members having abutment portions and defining a fuse receiving slot;

(b) contact means arranged within said fuse receiving slot; and (c) unitary fuse carrier means formed of molded insulating material including spaced parallel limb portions connected at one end to a common portion, said common portion including a C-shaped protrusion opposite said limb portions embracing a notch resiliently engageable with the fuse, the free ends of said limb portions extending from said fuse receiving slot and including outwardly extending finger-grip portions with serrated outer surfaces, said limb portion further including centrally disposed rib portions including outwardly projecting catch means spaced from said finger-grip portions said catch means cooperating with said first body wall abutment portions to secure said fuse carrier means within said fuse receiving slot, whereby when said fuse carrier means is arranged within said fuse receiving slot, the conductive end caps of the fuse are in contact with said contact means, and upon deflection of said limb means toward one another, said catch means are released from said first body wall abutment portions and said fuse carrier means is displaceable from said fuse receiving slot.

7. An electric fuse holder for a fuse having an insulated body portion arranged between conductive end caps, comprising (a) a body member formed of insulating material, said body member including
  (1) means for securing said body member to a support member, and
  (2) first wall members defining a fuse receiving slot;

(b) contact means arranged within said fuse receiving slot; and (c) fuse carrier means formed of insulating material adapted to be received by said fuse receiving slot as the carrier means is moved along a straight line path of motion and including
  (1) fuse gripping means for gripping the insulated body portion of the fuse, and
  (2) spaced, resilient limb means each having one end adjacent said fuse gripping means and having a free end which extends from said fuse receiving slot,
  (3) coacting means on said body member and limb means detachably retaining said carrier means in said body member.

8. A fuse holder as defined in claim 7, wherein said means for securing said body member to a support member comprises (d) locating means which abut against one surface of an apertured laminar panel support member; and (e) resilient retaining means which engage the other surface of said panel support member to retain said body member therein.

9. A fuse holder as defined in claim 17, wherein (f) said locating means comprise shoulder members formed on the end portions of said body member, said shoulder members extending laterally outwardly from said body member to define a plane; and (g) said retaining means comprise outwardly curved outer first wall portions of said body member extending toward said plane and including slantingly serrated free ends.

* * * * *